US006727400B2

(12) United States Patent
Messier et al.

(10) Patent No.: US 6,727,400 B2
(45) Date of Patent: Apr. 27, 2004

(54) DEACTIVATION OF TOXIC CHEMICAL AGENTS

(75) Inventors: Pierre Messier, Ste-Marguerite (CA); Norbert Laderoute, Westmount (CA); John Moorehead, Westerville, OH (US); Lindy DeJarme, Columbus, OH (US); Lynette Blaney, Hilliard, OH (US)

(73) Assignee: Triosyn Holdings, Inc.

( * ) Notice: Subject to any disclaimer, the term of this patent is extended or adjusted under 35 U.S.C. 154(b) by 0 days.

(21) Appl. No.: 09/327,827

(22) Filed: Jun. 8, 1999

(65) Prior Publication Data

US 2002/0016524 A1 Feb. 7, 2002

(51) Int. Cl.[7] ..... A62D 3/00
(52) U.S. Cl. ..... 588/200
(58) Field of Search ..... 588/200

(56) References Cited

U.S. PATENT DOCUMENTS

| | | | | |
|---|---|---|---|---|
| 3,817,860 A | | 6/1974 | Lambert et al. | |
| 3,923,665 A | | 12/1975 | Lambert et al. | |
| 4,238,477 A | | 12/1980 | Lambert et al. | |
| 4,420,590 A | | 12/1983 | Gartner | |
| 4,784,699 A | | 11/1988 | Cowsar et al. | |
| 4,798,870 A | | 1/1989 | Lyle, Jr. et al. | |
| 4,874,532 A | | 10/1989 | Worley | |
| 4,883,608 A | * | 11/1989 | Trujillo et al. | 252/189 |
| 4,885,327 A | | 12/1989 | McMahon, Jr. et al. | |
| 5,069,797 A | | 12/1991 | Bartram et al. | |
| 5,126,309 A | | 6/1992 | Chromecek et al. | |
| 5,143,621 A | | 9/1992 | Bartram et al. | |
| 5,431,908 A | | 7/1995 | Lund | |
| 5,639,452 A | | 6/1997 | Messier | |
| 5,689,038 A | | 11/1997 | Bartram et al. | |
| 5,710,358 A | | 1/1998 | Yang et al. | |
| 5,859,064 A | | 1/1999 | Cronce | |
| 5,980,827 A | * | 11/1999 | Messier | 422/37 |

FOREIGN PATENT DOCUMENTS

| | | |
|---|---|---|
| DE | 4114560 A1 | 5/1992 |
| GB | 2331298 A | 5/1999 |
| WO | WO 99/46990 | 9/1999 |

* cited by examiner

*Primary Examiner*—Steven Bos
*Assistant Examiner*—Anthony Kuhar
(74) *Attorney, Agent, or Firm*—Goodwin Procter LLP

(57) ABSTRACT

A method for deactivating a toxic chemical agent comprising contacting said toxic chemical agent with an halogenated resin.

16 Claims, 3 Drawing Sheets

DEACTIVATION OF TOXIC CHEMICAL AGENTS

Figure 1:
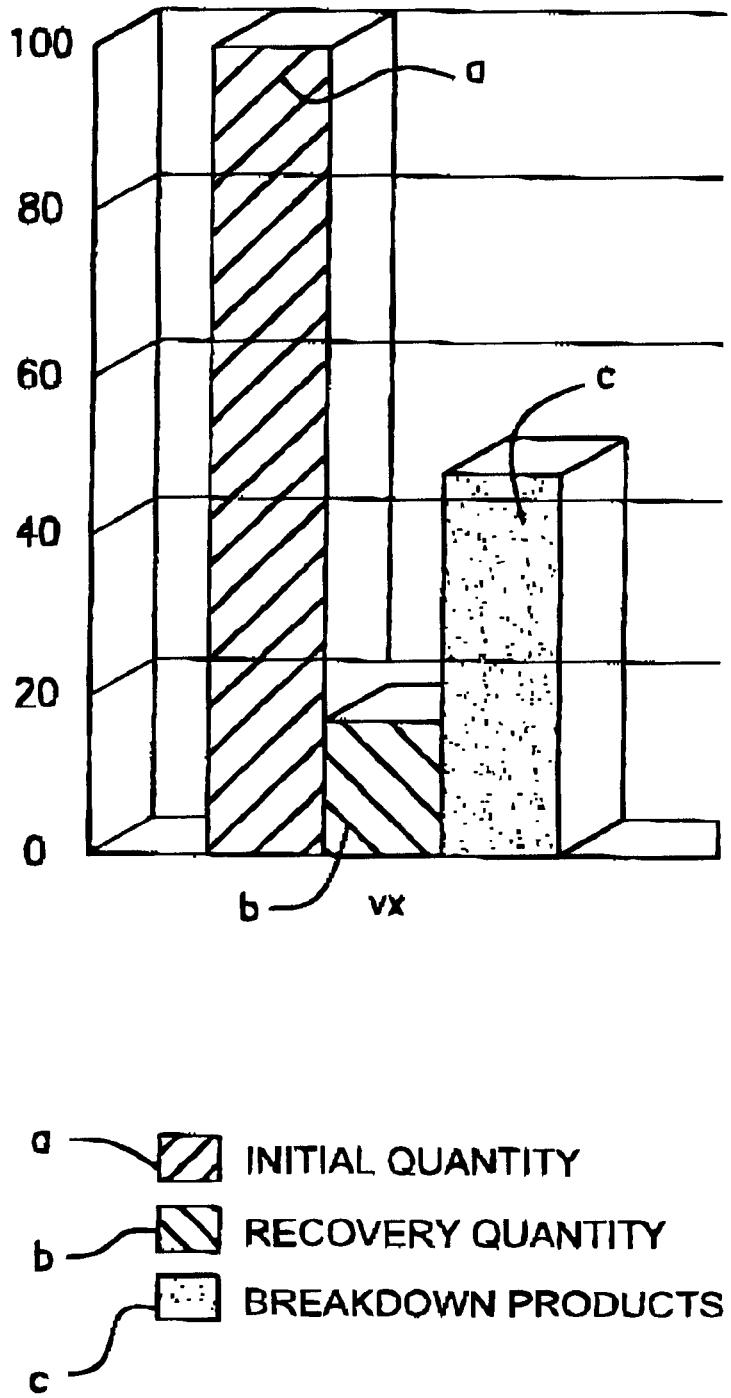

This invention relates to means for deactivating toxic chemical agents. The present invention in particular relates to polymeric or resin deactivation substances or compositions which may be used for the deactivation of toxic chemical agents.

Toxic chemical agents are chemical substances in gaseous, liquid, or solid form, which may, for example, induce choking, blood poisoning, nerve poisoning, etc., in humans and other animals. Chemical warfare agents are examples of toxic chemical agents which may be treated in accordance with the present invention. The present invention will be described hereinafter, in particular, by way of example only, in relation to chemical warfare agents but is applicable to other toxic chemical agents such as pesticides for example.

Over the years, various highly toxic chemical warfare agents have been stockpiled by several nations. The chemical warfare agents include among other substances a variety of organophosphorus and organosulfur compounds. One commonly known chemical warfare agent is Bis-(2-chloroethyl) sulfide, also known as HD). The chemical warfare agents commonly known as G-agents are examples of highly toxic nerve agents; they include TABUN (GA), SARIN (GB), and SOMAN (GD); GD is pinacolyl methylphosphonofluoridate. The G-agents are broadly organic esters of substituted phosphoric acid.

The phosphonothiolates are in particular highly toxic chemical warfare nerve agents currently stockpiled by various governments. The most commonly known of these nerve agents is O-ethyl S-(2-diisopropylamino)ethyl methylphosphonothiolate which is known as VX. VX and its congeners having the phosphonothiolate structure of formula (I)

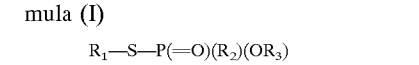

$$R_1—S—P(=O)(R_2)(OR_3) \quad (I)$$

wherein each of $R_1$ $R_2$ and $R_3$ is selected from the group consisting of hydrogen and an appropriate organic radical or organic functional group; $R_1$ may for example be selected from the group comprising (dialkylamino)alkyl wherein each alkyl group is independently selected from the group comprising straight and branched lower alkyl of 1 to 6 carbon atoms ; $R_2$ may for example be selected from the group comprising straight and branched lower alkyl of 1 to 6 carbon atoms; and $R_3$ may for example be selected from the group comprising straight and branched lower alkyl of 1 to 6 carbon atoms. An alkyl group may for example be methyl, ethyl, isopropyl or the like.

Examples of known techniques for the deactivation of toxic chemical agents may be found in the following U.S. patents the entire contents of each of which is incorporated herein by reference: namely, U.S. Pat. Nos., 4,784,699, 4,874,532, 4,883,608, 5,069,797, 5,126,309, 5,143,621, 5,689,038, 5,710,358 and 5,859,064.

Methods used over the yeas to deactivate toxic chemical agents such as for example the above mentioned such chemical warfare agents have each had problems associated with them such as hazardous reaction products.

The reaction (e.g. hydrolysis) products of VX may, for example, include EA2192, which is nearly as toxic as G series agents; EA2192 is a phosphonothioic acid which has the same basic structure as VX except that $R_3$ is a hydrogen atom (see Formula (I) above). Thus, hydrolysis-based decontamination schemes are not effective against VX.

In view of the biological hazards associated with chemical warfare agents, there is thus a continuing interest in the development of decontamination or deactivation means for the disposal of unwanted stockpiles of chemical warfare agents such as, for example, the stockpiles of the nerve agent VX. There is in particular a continuing need for an effective neutralisation method for the deactivation of toxic chemical agents.

It would be advantageous to have a process for deactivating toxic chemical agents such as, for example, nerve agents at a rapid rate, the nerve agents being in a solid or fluid phase (e.g. in a gaseous or liquid phase), the deactivating agent being a non-aqueous solid phase deactivating agent.

It would in particular be advantageous to have a deactivation means which does not depend on the use of water in order to function, which is capable of use at low temperatures (e.g room temperatures); etc..

It would further be advantageous to have a process for rapidly and safely decontaminating large (e.g. military, commercial, etc..) quantities of such chemical agents.

The present invention relates generally to a resin composition or substance for the deactivation of toxic chemical agents; it in particular relates to halide or halogenated resins (e.g. halide impregnated resins) for the deactivation of toxic chemical agents (e.g. in solid, gas and/or liquid form).

Iodine/resin substances have been proposed for use as a demand disinfectant against biological agents, namely against microorganisms such as fungi, bacteria, viruses etc. As used herein, "biological agent" refers to hazardous biological organism including fungi, viruses and bacteria, (whether in the form of spores or otherwise), as well as eukaryotic parasites such as Giardia.

U.S. Pat. Nos. 3,817,860, 3,923,665, 4,238,477, 4,420,590, 5,431,908, and 5,639,452 describe such iodine/resin substances for devitalising microorganisms; the entire contents of each of these patents is incorporated herein by reference. U.S. Pat. No. 5,639,452, in particular discloses a (demand) disinfectant substance comprising an iodine impregnated ion exchange resin in which the iodine is more tenaciously associated with the resin than with previously known (demand) iodine impregnated resin disinfectants.

It has been determined that halogen/resin substances may be used for the deactivation of toxic chemical agents, i.e. agents other than biological agents.

Thus the present invention in a general aspect provides a method for deactivating a toxic chemical agent comprising contacting said toxic chemical agent with an halogenated resin. The expressions halogenated resin, halide-resin and the like are to be understood herein as including or relating to resin wherein halogen is absorbed or impregnated therein.

The terms "deactivate", "deactivation" and the like are to be understood as meaning to render any such toxic chemical agent inactive, ineffective, or substantially less effective for causing harm to life or health, and particularly human life or health. Thus such (deactivation) contact is of course to be for a sufficient time and under conditions which are sufficient to produce a reaction product having less toxicity than said toxic chemical agent (e.g. contact with a deactivating amount of a halogenated resin).

The present invention in an additional aspect provides a method for reducing or eliminating unwanted or undesired stockpiles of a toxic chemical agent susceptible to deactivation (e.g oxidation) by halogen substance, which comprises deactivating a toxic chemical agent by contacting said toxic chemical agent (e.g. in a confining means) with an halogenated resin (i.e. with a deactivating amount of a halogenated resin). Such contact is of course to be for a sufficient time and under conditions which are sufficient to produce a reaction product having less toxicity than said toxic chemical agent. The confining means may be a sealed container, a chromatographic like column packed with halogenated resin, etc..

The present invention in another aspect provides a system for deactivating a toxic chemical agent susceptible to oxidation by halogen substance, said toxic chemical agent being in a fluid phase, said system comprising means for providing a fluid path for the movement of fluid therethrough, and a halogenated resin disposed in said fluid path such that toxic chemical agent in said fluid phase passing through said fluid path is able to be brought into contact with said resin and be deactivated thereby.

The present invention in a further aspect provides a method for deactivating a toxic chemical agent, said toxic chemical agent being in a fluid phase (i.e. in a liquid, vapour or gas), said method comprising passing said toxic chemical agent in said fluid phase through fluid path means air over an halogenated resin such that said toxic chemical agents contacts said resin and is deactivated thereby.

The present invention in a further additional aspect provides a method for deactivating a toxic chemical agent, wherein when said toxic chemical agent is in a liquid or vapour phase, said method comprises passing said toxic chemical agent over an halogenated resin such that said toxic chemical agents contacts said resin and is deactivated thereby. Vapour phase chemical agent(s) may, for example, be solubilized in an appropriate solvent through any (known) means and the resultant solution may be passed over the halide-resin. However, it is to be noted that halogen fixing solvents and solvents reactive with the halogen/resin are to be avoided.

As used herein, "toxic chemical agent" means a hazardous chemical agent, including but not limited to chemical warfare agents such as the compounds known as GD, HD, and VX, and hazardous industrial chemical agents. The expression "toxic chemical agent" in particular includes any toxic chemical agents which may be susceptible to deactivation (e.g. oxidation) by a halogen substance, i.e. a halogen substance such as described herein. It is believed that the halide substances such as the halogenated resins described herein including those in the above mentioned U.S. patents herein will be effective to deactivate toxic chemical agents which are susceptible to deactivation (e.g. oxidation) by the halogenated substances.

A halogen resin is of course to be chosen on the basis it may be capable of reducing the activities of toxic chemical agents, i.e. on the basis that it is a deactivation halogen resin. The deactivating resin may be a demand-type deactivator, i.e., a substance from which halide ions are released almost entirely on a demand-action basis upon contact with a target agent but that does not otherwise release substantial amounts of the devitalizing and deactivating substance into the environment. Such a demand-type substance essentially would be capable of deactivating target agents on demand, at least until the halide-resin has been exhausted. Such resins as well as a process(es) for their preparation are for example described in U.S. Pat. No. 5,639,452, (Messier); the entire contents of this patent are incorporated herein by reference. Thus, for example, the halide-resin may comprise a demand iodinated anion exchange resin or, more particularly, the halide-resin may comprise a demand iodinated strong base anion exchange resin.

In accordance with the present invention a halogenated (e.g. iodinated) resin may be used as a deactivation chemical reagent against toxic chemical agents, namely toxic chemical agents such as nerve agents, e.g., VX and the G series of nerve agents.

In accordance with one further aspect of the present invention, phosphonothiolates and phosphonothioic acids (e.g. see above formula (I) with respect thereto) may be detoxified using a halogenated resin. In accordance with the present invention, a means (e.g. method, system, etc..) is thus in particular provided for detoxifying substituted and unsubstituted phosphonothiolates and phosphonothioic acids (e.g. VX). As mentioned above, the phosphonothiolate or phosphonothioic acid is contacted with a sufficient amount of a halogenated resin (e.g. demand halogenated resin), for a sufficient time and under conditions sufficient to produce a reaction product having less toxicity than the phosphonothiolate or phosphonothioic acid.

The chemical warfare agent to be treated in accordance with the present invention may for example be from the group consisting of bis-(2-chloroethyl) sulfide (HD), pinacolyl methylphosphonofluoridate (GD), and O-ethyl S-(2-diisopropylamino)ethyl methylphosphonothiolate, (VX).

Deactivation contact is of course to be for a sufficient time and under conditions (i.e. residence or contact time, concentration ratios, temperature, pressure and the like) which are sufficient to produce a reaction product having less toxicity than the toxic chemical agent.

The deactivation contact for the method(s) system etc, of the present invention may as mentioned above take place within confining means; the confining means may, for example, be a sealable container in which the reactants may be placed for reaction and unsealed to remove the reaction product(s) (e.g. reactor with a sealable cover). Alternatively, the confining means may take the form of a chromatographic like column packed with halogenated resin, the column defining a fluid path means for the movement of fluid therethrough etc..

Deactivation of toxic chemical agents may be accomplished by mixing the toxic chemical with a deactivating amount of the described resin, e.g. such simple contact may occur in a sealed container.

The deactivation contact may, as mentioned above, take place in a chromatographic like column by packed with halide-resin. The column may be sized so as to have any desired or necessary length to width ratio; the length to width ratio may for example be 20:1. The halide-resin packed into the column may be comprised of particles of the sizes discussed herein; the halide-resin may in particular comprise a 20 micron powder, i.e. at least a substantial amount of the halide resin is about 20 microns in size. The column may have fluid input and fluid output means for the delivery to and removal therefrom of a fluid phase material. The flow rate of toxic chemical agent (in a fluid phase) through the column may be selected so as to provide the desire residence time; e.g. flowthrough may be such as to provide a 10 minute exposure of the toxic chemical agent to the halide-resin, The column if so desired or necessary may be provided with a transparent wall about one third the way down from the top of the column; this transparent portion may be used for visual verification of the continuing activity of the resin, i.e. as the iodine is expended the colour of the resin will change so as to give some forewarning that resin is losing its potency and needs to be replaced.

As mentioned above the contact between the halide-resin and the toxic chemical agent is to be for a sufficient time and under conditions which are sufficient to produce a reaction product having less toxicity than said toxic chemical agent. For purposes of the present invention, it will be understood by those of ordinary skill in the art that the term "sufficient" as used it conjunction with the terms "amount", "time" and "conditions" represents a quantitative value which represents that amount which provides a satisfactory and desired result, i.e. detoxifying toxic chemical agents. The amounts, conditions and time required to achieve the desired result will, of course, vary somewhat based upon the type and amount of toxic chemical agent present, Temperature may be dependent on the chemical to be deactivated; temperature may be selected so as to reduce the partial vapour pressure of the chemical to a minimum level while maintaining a viscosity capable of allowing mixing of the toxic chemical agent and the halide-resin. The contact may for example occur at 22 degrees C. for VX and detoxification may occur in less than 1 hour. Commonly, the halide resin will be used in volumetric excess relative to the toxic chemical agent, e.g. for treating VX the volumetric ratio may be 3 parts (e.g. by volume) halide resin (e.g. a halide-resin comprising 50% by weight iodine) to 2 parts VX (e.g. by volume). In order to insure total detoxification, it may be necessary to utilize a relatively large excess of the decontaminating chemical compound i.e, halide-resin vis-a-vis the toxic chemical agent.

In accordance with the present invention, a halogen substance capable of deactivating toxic chemical agents may comprise halide-resin (i.e. halogenated-resin) particles; the particle or granular from is advantageous due to the high surface area provided for contact with the toxic chemical agent (see U.S. Pat. No. 5,639,452). The halide-resin particles may, for example, be selected or segregated so as to obtain an amount (i.e. group) of particle wherein all or at least a substantial proportion (or amount) of said segregated particles have a particle size greater than 300 microns; the segregated halide-resin may, for example, comprise granules or particles having a size in the range of from 0.2 mm to 0.8 cm (e.g. of from 0.35 mm to 56 mm). On the other hand, in accordance with a particular aspect of the present invention all or at least a substantial proportion (or amount) of the segregated halide-resin particles may have a particle size in the range of about 0.1–300 microns; the halide-resin particles may, for example, have a particle size substantially in the range of about 0.1–3 microns, 3–5 microns, 3–15 microns, or 5–15 microns. Depending on the requirements the halide-resin may, if so desired, comprise a mixture of particles having a large or wide range of particle sizes; e.g. the halide resin may comprise 1 part by weight beads (e.g. 0.2 to 0.5 mm), 2 parts by weight fragments (e.g. 150 to 300 microns) and 1 part by weight dust sized particles (e.g. 0.1 to 3 microns). As used herein the expression "a substantial proportion" in relation to particle size is to be understood as characterizing the particles as comprising at least a majority (i.e. more than 50%) by weight of the particles.

In accordance with the present invention a halogen substance capable of deactivating toxic chemical agents may comprise halide-resin particles comprising polyhalide ions having a valence of −1 absorbed or impregnated into resin particles; the particles may have a size as mentioned above, e.g. the particles may have a particle size substantially in the range of about 0. 1–300 microns.

The halide-resin may be characterized in that it may be obtained from a process wherein an activated halogenated resin (i.e. an initially halogenated resin) may be ground and segregated into particles of desired size, e.g. particles substantially in the range of about 0.1–300 microns. Thereafter the particles of desired size may be exposed to a sufficient amount of a halogen-material absorbable by the activated resin to form converted resin particles having a greater proportion of available ionic halogen (relative to the initial ground activated halogen-resin), with the halogen-material being selected from the group consisting of $I_2$, $Cl_2$, $Br_2$, F as well as polyiodide ions having, a valence of −1.

As used herein, the terms "polyhalide," "polyhalide ions," and the like refer to or characterize a material or a complex that has three or more halogen atoms and a valence of −1, and which may be formed if a molecular halogen (e.g., bromine as Br) combines with a monovalent trihalide ion (e.g. a triiodide ion) or pentahalide ion (pentaiodide ion). Iodine and chlorine also may be used as a source of molecular halogen, Similarly, the terms "polylodide," "polyiodide ions," and the like refer to or characterize a material or a complex that has three or more Iodine atoms and that may be formed if molecular iodine combines with the monovalent triiodide ion. The terms "triiodide, "triiodide ion," and the like refer to or characterize a material or a complex that contains three iodine atoms and has a valence of −1. The triiodide ion herein therefore is a complex ion which may be considered as comprising molecular iodine (i.e., iodine as $I_2$) and an Iodine ion (I—).

The invention includes a method of making a resin substance or composition, comprising the steps of providing an activated halide-resin (e.g. obtained by subjecting starting resin to the high temperature/pressure process described in U.S. Pat. No. 5,639,452 (herein sometimes referred to as the "Messier Process"));

forming the activated resin into particles;

selecting or segregating obtained halogen-resin particles substantially in the range of about 0.1–300 microns; and forming converted resin particles from the segregated particles of about 0.1–300 microns having a greater proportion of available ionic halogen relative to the initial segregated particles.

The activated resin may be used per se as a halide-resin for contact with a toxic chemical agent or as a starting material for an above mentioned converted halide-resin. The activated resin for making the converted halide resin may be an anionic triiodide resin, a divinyl styrene triiodide resin, etc.

The starting resin for the preparation of the activated resin may be any suitable (known) resin which may give rise to a halogenated resin able to deactivate a toxic chemical agent.

The starting resin for the preparation of the activated resin may be any (known) anion exchange resin (for example, with those such as are described in more detail in the above-mentioned United States patents such as U.S. Pat. Nos. 3,923,665 and 5,639,452). The starting resin may for example be a strong base anion exchange resin. A quaternary ammonium anion exchange resin is, however, preferred. As used herein, it is to be understood that the expression "strong base anion exchange resin" designates a class of resins which either contain strongly basic "cationic" groups, such as quaternary ammonium groups or which have strongly basic properties which are substantially equivalent to quaternary ammonium exchange resins. U.S. Pat. Nos. 3,923,665 and 3,817,860 identify a number of commercially available quaternary ammonium resins, as well as other strong base resins including tertiary sulfonium resins, quaternary phosphonium resins, alkyl pyridinium resins and the like. The starting resin may be a strong base anion exchange resin having strongly basic groups in a salt form; the resin may be in any salt form provided that the anion is exchangeable with the iodine member (e.g. with triiodide ion). The starting resins which may be used herein may, for example, be in a hydroxyl form, a chloride form, an iodide form or in another salt (e.g. sulphate) form provided as mentioned above, that the anion is exchangeable with the iodine member (e.g. with triiodide ion). In accordance with the present invention the anion exchange resin may, for example, be a quaternary ammonium anion exchange resin; in his case the anion exchange resin may be in the iodide form $I^-$, in the chloride form $Cl^-$; in the hydroxyl form $OH^-$; etc..

Commercially available quaternary ammonium anion exchange resins which can be used in accordance with the present invention include in particular, Amberlite IRA-401 S, Amberlite IR-400 ($Cl^-$), Amberlite IR-400 ($OH^-$), etc., (from Rohm & Hass) which may be obtained in granular form. These resins may for example, contain quaternary ammonium exchange groups which are bonded to styrene-divinyl benzene polymer chains.

Converted resin particles may be formed by again following the process as described in U.S. Pat. No. 5,639,452 i.e. after particle segregation the halide-resin particles of desired size (i.e. of size less the 300 microns) may be subjected to the "Messier Process". Thus converted resin particles may be formed by exposing the segregated halogen-resin particles to a sufficient amount of a halogen-material to form converted resin particles. The halogen-material may, for example, be selected from the group consisting of $Cl_2$, $I_2$, $Br_2$, polyhalide ions having a valence of −1 and mixtures thereof. Absorption of at least a portion of the halogen-material may be effected at elevated temperatures, i.e., temperatures higher than 100° C. and up to 210° C., and elevated pressures, i.e., pressures greater than atmospheric pressure and up to 100 psi. (for suitable process conditions please see U.S. Pat. No. 5,639,452 mentioned above).

The reaction product(s) obtainable by treating VX with a halide-resin as described herein shows significantly reduced toxic effects for the major reaction products identified, Although the exact chemical route leading to the deactivation of VX is not fully understood, the reaction does not appear to lead to a dynamic equilibrium and the reforming of VX. It may be interrupted by introducing a stop reaction agent such as for example sodium thiosulphate, ascorbic acid and the like. Thus the reaction may be stopped by such stop reaction agent, once a desired product ratio has been achieved relative to the initial amount of toxic chemical agent; the reaction products (or a separated fraction thereof) may as desired or necessary be recontacted with halide resin as desired or necessary. The desired stopping point may vary depending on the desired outcome, for example on whether a least toxic material may be obtained, whether the obtained product (s) may be a useful by-product(s), whether the obtained product (s) may be safely incinerated. This exemplified procedure may be applicable to other phosphonothiolates and phosphonothioic acids and including substituted phosphonothiolates and phosphonothioic acids the treatment conditions of which may be easily determined by those skilled in the art.

If desired, to tailor the reaction products to eliminate potentially toxic products, a toxic chemical agent (e.g. VX) may possibly be contacted with a deactivating amount of a halogenated resin either in the presence of liquid $I_2$ or after an initial contact between the toxic chemical agent and liquid $I_2$. A contact between liquid $I_2$ and VX for example may lead to the formation of EA2192 which when contacted with halide-resin as described herein may lead to a mixture without VX or EA2192. This pretreatment may be used to remove $R_1$ or $R_3$ (e.g. ethyl) group to prevent formation of a minor reaction product and EVX which is a substitution product derived by removing the $R_1$ or $R_3$ and insert or attaching it to the $R_2$ group.

Figure 2A:
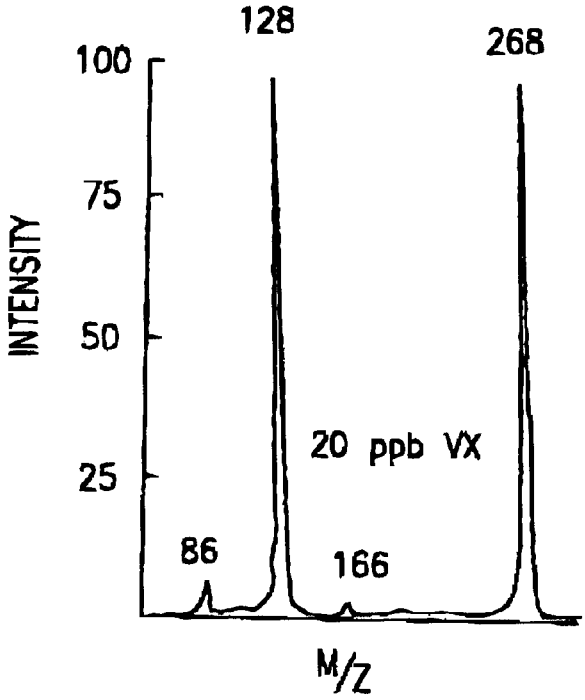
Figure 2B:
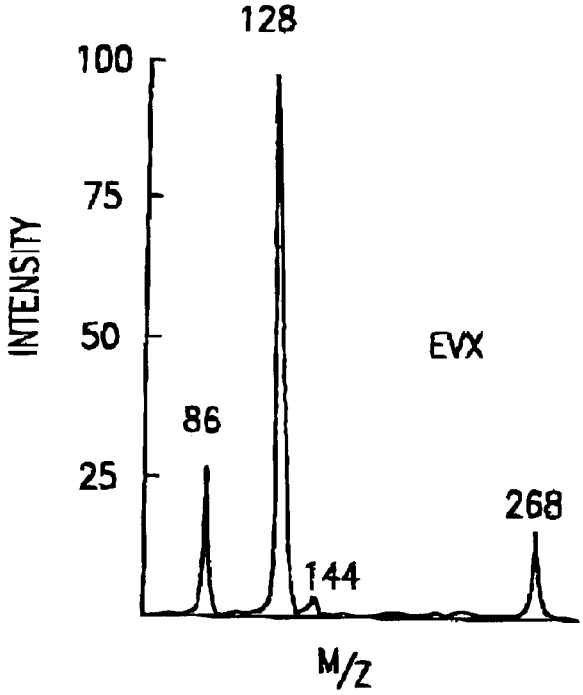
Figure 3:
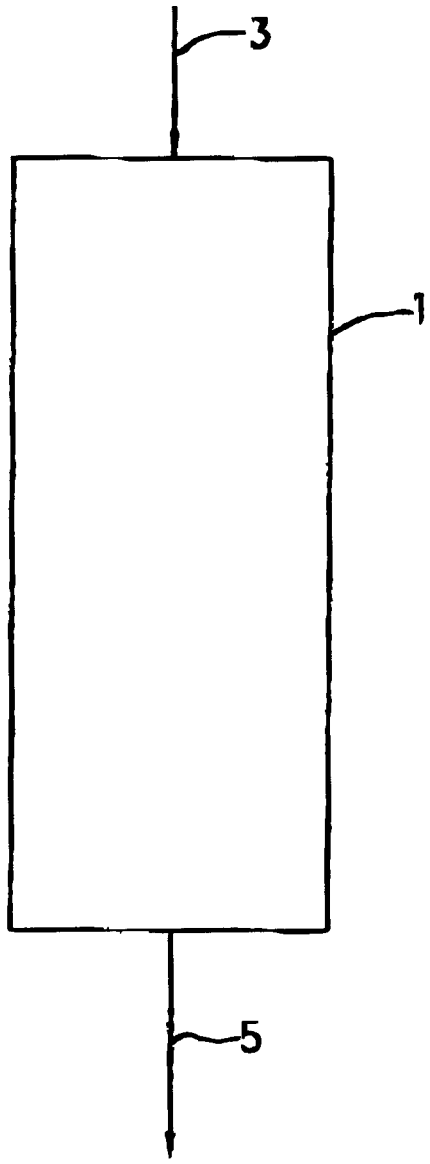

In drawings which illustrate example embodiments of the present invention:

FIG. 1 is a graph showing the effectiveness of a triiodide-resin according to the presentt invention against the chemical warfare agent VX;

FIGS. 2*a* and 2*b* respectively show the product spectra of the protonated authentic VX sample (20 μg/ml), and the protonated compound EVX (material distinguishable from VX);

FIG. 3 is a schematic illustration of a chromatographic like column for contacting halide-resin with toxic chemical agent.

The halogen resin substance of the present invention may be prepared starting with a commercially available polyhalide-resin. The starting resin may comprises polyhalide ions having a valence of −1 absorbed or impregnated into the resin. The starting resin may in particular be a polylodide-resin, most preferably, triiodide-resin (i.e., resin having, triiodide ions of formula $I_3$- absorbed thereon). Preferred starting resins include Triosyn (registered trademark) iodinated divinyl styrene-based resins, available from Hydro Biotech, Québec, Canada.

The starting polyhalide-resin may take any commercially available form, for example, finely divided fragments or granules, particles, beads, plates or sheets etc..

Generally, the starting polyhalide-resin may be prepared from a porous strong base anionic exchange resin in a salt form. The anion exchange resin is exposed to a sufficient amount of a halogen-material (such as those described herein) absorbable by the anion exchange resin so as to convert the anion exchange resin into an "halide-(or halogenated) resin" (i.e. an activated halide-resin). For example, a suitable triiodide starting resin may be prepared from a divinyl styrene ion exchange resin by using the "Messier Process". It is believed that halogenated resins prepared using a quaternary ammonium ion exchange resin as described in U.S. Pat. No. 5,431,908 to Lund an other suitable anion exchange resins also may be useful in the practice of this invention, (i.e. after particle segregation the halide particles may be subjected to the "Messier Process"). Ion exchange resins useful in the practice of the invention typically may be available in the chloride or sulfate form in which case the ion exchange resin may, as desired, be converted to the iodide ($I^-$) or bromide ($Br^-$) form of the resin before initial activation.

Halogen-materials useful in preparing the activated resin may comprise any of the halogen group of materials that may give rise to an active halide-resin (i.e. a deactivating halide-resin). The halogen-material typically may be selected from the group consisting of diatomic iodine, diatomic bromine, and polylodide ions having a valence of −1. The term "halogen-substance" includes a polyhalide salt carrier solution circulated in contact with a element halide as described by Lund.

The activated resin may be processed to (mechanically) segregate and obtain resin particles of the desired particle size, preferably substantially in but not limited to the range of about 0.1–300 microns, including, by way of example, ranges of about 0.1–3 microns, 3–15 microns, and 15–300 microns. Small particles are desirable because they provide a high surface area for interaction with toxic chemical agents.

Resin particles of the desired size may be produced by processing the activated resin (preferably starting with the bead form) using conventional non cryogenic grinding and/or milling devices. Satisfactory results have been obtained using an impact grinder with a stainless steel wheel in combination with a jet mill. Consistent feed and extraction rates are helpful. The resultant powder is sieved to remove oversized particles, which may be reprocessed. Undersized particles generally are discharged during processing. Scale-up may, however, be achieved using a cryogenic grinding process.

Commercially available ion exchange resins (such as those used to produce the activated resin described herein) are difficult to process into particles within the desired 0.1 to 300 micron range before activation of the resin and loss rates may be expected to be unacceptable even when it is possible to do this. Initial halogenation of the starting resin alters its crystal structure, and thus its fracture properties, making grinding and milling somewhat easier. A resin having, an iodine content of at least about 30% may for example be used to achieve reasonably grindable resin. Resins having an even higher iodine content are likely to exhibit improved grindablility. In any event it is nevertheless is to be understood that the starting resin itself may be ground (e.g. cryogenically) to provide particles of 0.1 to 300 microns and these ground starting particles may be subjected to the Messier Process (i.e. directly).

Conversion of activated resin to converted resin may be accomplished by subjecting finely divided particles of an activated halide-resin to a repeat of the "Messier Process". In general the conversion is accomplished by contacting finely divided particles of an activated halide-resin with a sufficient amount of a halogen-material absorbable by the activated resin to form converted resin particles having a greater proportion of available ionic halogen i.e. relative to the initial ground halide resin particles as a whole.

The following description will provide a general outline of the "Messier Process" to which the ground particles nay be subjected; the comments will of course apply equally to the preparation of activated resin from a starting resin; for more details see U.S. Pat. No. 5,369,452.

Conversion may be accomplished, for example, by exposing the activated resin particles to a sufficient amount of a halogen material absorbable by the activated resin to form converted resin particles. The halogen-material used in accomplishing this conversion may be any material or material capable of donating a halogen-member absorbable by the activated resin to form converted resin particles; the donatable halogen-member may be diatomic iodine, diatomic bromine, or a polyiodide ion having a valence of −1. Examples of such materials include compositions comprising iodine ($I_2$), bromine ($Br_2$) and alkali metal or other halides, such as potassium iodide, sodium iodide and ammonium iodide in association with water. For example, iodine may be combined with the preferred alkali metal halide, potassium iodide and a minor amount of water, i.e. an amount of water sufficient to avoid $I_2$ crystallisation. The composition may contain monovalent iodine ion that may combine with diatonic Iodine ($I_2$) to form a polyiodide ion.

Unless preparation of a mixed halide resin is desired, the halogen- material selected comprises the same halide as is present in the activated resin. For example, the halogen material used for conversion of a Triosyn activated resin would comprise an iodine material, i.e. a material selected from the group comprising crystalline of iodine ($I_2$)and polyliodide ions having a valence of −1.

The total amount of halogen to be contacted, with the activated resin, residence times, reaction conditions and the like will depend upon such factors as the nature of the polyhalide it is desired to introduce into the structure of the activated resin, the nature of the activated resin, the intended use of the converted resin, and the desire to minimize the amount of unabsorbed halogen that must be washed from the converted resin particles. The ratio of iodine to resin in the converted resin composition may be in the range of about 50%.

In accordance with the present invention, conversion of the activated resin, and particularly Triosyn resin, may be effected at elevated temperature greater than 100° C., for example in the range of 105° C. to 150° C. (i.e., 110° to 115° C. to 150° C.), the upper limit of the temperature used will depend, among other things, on the characteristics of the resin being used. The elevated pressure is any pressure above ambient pressure (e.g., a pressure greater than atmospheric or barometric pressure, i e. greater than 0 psig). The pressure may, for example, be 1 psig or higher, e.g., in the range from 5 to 50 psig; the upper limit of the pressure used will depend, among other things, on the characteristics of the resin being used.

The conversion at elevated conditions may be effected in a reactor that is pressure sealable during conversion but that may be opened for recovery of the resin product after a predetermined reaction time. The process may thus be a batch process wherein conversion at elevated temperature and pressure is effected once the reactor is sealed. The reactor may be sized and the amount of reactants determined so as to provide a valid space in the reactor during, reaction such that contact takes place under an essentially halogen-rich atmosphere, The pressure in the closed vessel or reactor used to convert the resin to a polyhalide may be a function of the temperature, such that the pressure may vary with the temperature approximately in accordance with the ideal as equation PV=n-RT, wherein V=the constant (free) volume of the reactor, n=moles of material in the reactor, R is the universal gas constant, T is the temperature and P is the pressure. In a closed vessel) the temperature of the system may therefore be used as a means of achieving or controlling the desired pressure in the vessel depending upon the makeup of the halogen-material in the reactor. Thus, a reaction mix disposed in a pressure sealed reactor array, for example, be subjected to a temperature of 105° C. and a pressure of 200 mm Hg.

Alternatively, a relatively inert gas may be injected into a sealed reactor to induce and/or augment the pressure in the reactor, Iodine, an inert (noble) gas, air, carbon dioxide, nitrogen or the like may be used as a pressuring gas, provided the chosen gas does not unduly interfere with the production of a suitable halogenated resin, If pressure is to be induced by steam, steps should be taken to isolate the reaction mix from excess water. The inert gas preferably is used to augment the pressure resulting from the use of elevated temperatures to effect conversion.

The residence or contact time at the elevated conditions may vary depending upon the starting materials, contact conditions, amount of tenaciously held halogen it is desired to be absorbed by the activated resin, and other process factors. The contact time may thus take on any value; however, it is expected generally that the contact time under the conditions used will be sufficient to maximize the amount of tenaciously held halogen absorbed from the material containing the absorbable halogen-material. The residence time may for example be as little as 5 to 15 minutes (in the case where a pre-impregnation step is used, as described below) or several hours or more (e.g., up to 8 or 9 hours or more).

The elevated temperature/pressure contact conditions may be chosen to maximize the halogen content of the obtained halide-resin, For Triosyn resins in which the halogen material used during conversion includes crystalline of iodine, exposure of the activated resin to, the halogen-material at a temperature and pressure at or about the triple point of crystalline of iodine is believed to promote absorption of the maximum amount of available iodine.

It is believed that other halide resins as well as mixed polyhalide-resins also may be useful in the practice of the invention. The preparation of mixed polyhalide-resins may be carried out in two steps. In the first step, the activated resin may be exposed to a halogen-material containing a first elemental halogen (e.g, diatonic iodine) in a quantity sufficient to form some converted polylodide-resin and unconverted resin. In the second step, the resin mixture may be exposed to a halogen-material containing a second elemental halogen (e.g., diatomic bromine, chlorine, etc..) in a quantity sufficient to convert the unconverted resin to polyhalide-resin.

The converted halide-resin may be treated prior to use to remove any water-elutable iodine, such as, for example, potassium iodide, from the surface of the halide-resin so that on drying of the resin, no crystals of halogen compounds will form on the surface of the halide-resin. The treatment (e.g., washing) may be continued until no detectable iodine (e.g. a total iodine content of less than 0.5 parts per million) or other halogen is found in the wash water. Any suitable iodine test procedure may be used for iodine detection purposes, if desired.

Throughout this specification, when a range of conditions or a group of substances, materials, compositions, temperature, pressure, time, etc. is defined with respect to a particular characteristic of the present invention, the present invention relates to and explicitly incorporates each and every specific member and combination of sub-ranges or sub-groups therein. Any specified range or group is to be understood as a shorthand way of referring to each and every member of a range or group individually as as each and every possible sub-range and sub-group encompassed therein; and similarly with respect to any sub-ranges or sub-groups therein. Thus, for example, a pressure greater than atmospheric is to be understood as specifically incorporating each and every individual pressure state, as well as sub-range, above atmospheric, such as, for example, 2 psig, 5 psig, 20 psig, 35.5 psig, 5 to 8 psig, 5 to 35, psig 10 to 25 psig, 20 to 40 psig, to 35 to 50 psig, 2 to 100 psig, etc.

The converted resin particles may be used to deactivate toxic chemical agents and other industrial toxic chemicals with a $\pi$ bond of sufficient energy to facilitate the reaction with iodine. The time necessary for the deactivating capability of the resin particles to take effect may depend on the closeness of the contact between the particles and the target agent and the type of agent. Deactivation of chemical agents may take place within tens of minutes of initial contact.

A triiodide-resin according to the present invention was tested against the chemical warfare agent VX. The converted resin was prepared from Triosyn, T-50 resin that had been ground to particles in the range of about 3–15 microns and converted using crystalline iodine such that the converted resin contained about 50% iodine; the initial Triosyn T50 (50% by weight iodine, particle size substantially 0.5 mm) was obtained from Hydro Biotech Quebec. 10 g of converted resin samples were spiked with 2 microliters of VX, (the "initial quantity" depicted graphically in FIG. 1 VX). Non-iodinated ion exchange resin beads (about 1.5 mm diameter) used as a control also were spiked with 2 microliters of the nerve agent.

After an exposure time of one hour, the agents were extracted from the samples using chloroform and analyzed by gas chromatography to give the "recovery quantity," or amount of the unreacted agent remaining in the sample at the end of this time. The quantity of breakdown products resulting from interaction of the agents with the converted resin also was determined for VX.

As shown in FIG. 1, a significant reduction in the effective amount of VX was observed. No measurable deactivation was noted for a non active resin control sample (i.e. a resin without halogen).

In the following,, the Triosyn beads for the tests were labeled Hydro Biotech, Quebec, Triosyn T50, Lot 70907; the beads were essentially 0.5 mm in size and contained 50% by weight iodine. The non-iodated beads were labeled Hydro Biotech, Triosyn inactivated.

Test were conducted to determine if chemical agents Soman (GD), Mustard (HD), and VX react with Triosyn. Both iodinated (Triosyn) and non-iodinated beads were tested to separate the effect of the Triosyn from the effect of the beads. Initial testing was performed to quantify the recovery of chemical agents from the Triosyn by solvent extraction. Offgas testing was then performed to determine if the agent was not extracted from the beads, but weakly adsorbed on the beads. The ratio of the recovery of VX from the Triosyn versus the non-iodated beads was less than 0.14; it was assumed that the agent had reacted with the Triosyn. Further testing was performed with VX to quantify the breakdown products. The ratio of the recovery of GD and HD from the Triosyn versus the non-iodated beads was greater than 88%, and it was assumed that the GD and ED did not as readily with the Triosyn to produce measurable deactivation products.

Gas chromatography (GC) with mass spectrometry detection (GC/MSD) was used for the analysis of the Triosyn resin and any breakdown products. GC with flame photometric detection (FPD) was used for analysis of offgas samples and contact samples, An offgas test rack was set up for bead offgas tests. The test system consisted of 24 aluminum offgas cells. The flow through the cells was controlled using rotometers, and the temperature of the test cells was maintained using strip heaters controlled by Omega temperature controllers, Toxic Chemical Warfare Agent Recovery: A chloroform solution containing GD, HD, and VX was prepared. Ten-mL samples of iodinated and non-iodinated resin were spiked with 300 $\mu$l of the solution of GD, HD, and VX allowed to be in contact for 1 and 4 hours contact time and then serial extracted with chloroform. The chloroform extracts were analyzed by GC/MSD. The recovery of the agent from the resin was determined and iodinated versus non-iodinated results compared. Five replicates of each iodinated and non-iodinated resin were prepared and extracted at each contact time.

Breakdown Products The VX exhibited degradation on the iodinated resin and was spiked individually as 300 $\mu$l of an 1,800 $\mu$g/H solution. The VX was allowed to contact the resin for 1 and 4 hours, extracted with chloroform to remove nerve agent, then extracted with methanol and with pH-adjusted water to remove breakdown products. The methanol and aqueous extracts were combined and concentrated to dryness. The remaining residue was derivatized with BSTFA (N,O-bis[trimethylsilyl]trifluoroacetamide) to form TMS (trimethylsilyl) derivatives of O-ethyl methylphosphonic acid (ENPA), and diisopropylaminoethanol (DIPAE). The GC/MS was then used to quantify the derivatized VX breakdown products.

Bead Offgas: Iodinated and non-iodinated beads were exposed to agents and extracted with chloroform using the nerve agent recovery procedures described above. The beads were transferred to an aluminum weighing dish, and the dish was placed in an aluminum test cell for offgas measurements. The agent offgassing from the cell was collected in a bubbler overnight (approximately 16 hours) at ambient conditions. The temperature of the test cells was then raised to 120° F. and the agent offgassing collected for an additional 8 hours, The bubblers were analyzed using the procedures described below (i.e. Offgasing Sample Analysis).

Offgassing Sample Analysis: Two 1-mL aliquots of the bubbler fluid were transferred to pre-labeled vials for agent analysis by gas chromatography (GC). One GC vial was analyzed and the other archived for repeat analysis, if required. The samples were analyzed for agent content using a Hewlett Packard 5890 gas chromatograph equipped with a flame photometric detector (FPD) or a flame ionization detector (FID)) for higher case.

Toxic Chemical Warfare Agent Recovery results: Ten-milliliter (10-ml) sample of each bead type were spiked with 300 μl of a matrix solution of GD, HD, and VX in chloroform. An analysis of the matrix solution resulted in agent concentrations of 7.18 mg/ml GD, 8.81 mg/ml HD, and 6.05 μg/ml VX. The mass of agent recovered was averaged for the 5 replicate samples at each test condition, and the results are shown in Table 1-1. The agent recover from the control samples ranged from 104% to 108% of the calculated amount of agent injected into the empty vial.

TABLE 1-1

Agent Recovery Results

| Bead Type | Contact Time (hr) | Agent Recovered (Average μg) GD | HD | VX | Percent Recovered (Recovered/Matrix) GD | HD | VX |
|---|---|---|---|---|---|---|---|
| Iodated | 1 | 2,132 | 2,122 | <100 | 99 | 84 | <6 |
| (Triosyn ®) | 4 | 1,124 | 584 | <100 | 52 | 22 | <6 |
| Non- | 1 | 2,034 | 1,877 | 1,778 | 94 | 71 | 98 |
| Iodated | 4 | 732 | 665 | 698 | 34 | 25 | 38 |
| None | 1 | 2,236 | 2,74 | 1,886 | 104 | 104 | 104 |
| (Control) | 4 | 2,294 | 2,858 | 1,893 | 106 | 108 | 104 |
| Matrix Standard | 0 | 2,154 | 2,644 | 1,816 | | | |

The VX recovery from the Triosyn beads was below the detection limits of the GC (gas chromatograph), while the recovery from the non-iodinated beads after 1 hour of contact was nearly 100%. This indicates that the VX was either reacting with, or was irreversibly sorbed to the Triosyn. The GD recovery from both Triosyn and non-iodinated beads with a 1-hour contact time was greater than 90%. The HID recovery from both bead types was less than the GD recovery, but the difference between the bead types was minimal.

After 4 hours of contact from both the iodinated (Triosyn) and non-iodinated beads the recovery decreased significantly for all three agents. This indicates that the agents may have been adsorbing into the bead pores or possibly reacting with the beads, Again, the difference in recovery of the HD and GD from the iodinated beads (Triosyn) and non-iodinated beads were minimal.

The ratio of the average recovery for each agent from the Triosyn versus the non-iodinated beads was calculated and is presented in Table 1-2. The ratio for average recovery for VX was less than 6% (1-hour) and less than 140% (4-hour) indicating that a reaction may have occurred with the Triosyn beads, and the test series for the determination of breakdown Products was performed. The ratio of the average recovery for GD and HD was greater than 90%, and it was assumed that the GD and HD did not react sufficiently with the Triosyn to Produce measurable amounts of hydrolysis products.

TABLE 1-2

Comparison of Iodated and Non-iodated Bead Recovery Results

| Agent | Contact Time (hr) | Average Recovered Triosyn ® | Average Recovered Non-iodated | Ratio (Triosyn ®/ Non-iodated) |
|---|---|---|---|---|
| GD | 1 | 2,132 | 2,034 | 1.05 |
| | 4 | 1,124 | 732 | 1.54 |
| HD | 1 | 2,122 | 1,877 | 1.13 |
| | 4 | 584 | 665 | 0.88 |
| VX | 1 | <100 | 1,778 | <0.06 |
| | 4 | <100 | 698 | <0.14 |

Breakdown Products: The breakdown products test was conducted to provide quantitation of breakdown product of VX. Ten millimeters (10 ml) of beads were spiked with VX in chloroform, with approximately 1,800 μg of the VX on the beads. The average mass of VX, DIPAE, and EMPA are shown in Table 1-3. No VX or breakdown products were extracted from the Triosyn beads. The GC/MS analytical method was not used to look for complexes between the VX or the breakdown products with the iodine.

TABLE 1-3

VX Breakdown Product Results

| Bead Type | Contact Time | Mass Recovered (Average μg) VX | DIPAE | EMPA |
|---|---|---|---|---|
| Iodated Triosyn ® | 1 hr | <100 | <50 | <50 |
| | 4 hr | <100 | <50 | <50 |
| Non-Iodated | 1 hr | 1,778 | 62 | 368 |
| | 4 hr | 698 | 49 | 542 |

Bead Offgas: Offgas testing provided information regarding residual agent on the beads which was not removed by the chloroform extraction. The amount of agent recovered by offgassing ranged from 2% to 21% of the total recovery, indicated that the extraction removed the majority of agent. Heating the beads to 120° F. produced additional recovery of less than 11 μg in all cases.

The following will deal with VX.; VX was reacted with Triosyn T50 beads leading to its degradation and possible rearrangement products.

A methanol extract was prepared by blowing down a chloroform extract from Triosyn treated with 1000 μg VX and reconstituted with methanol. The analytical results from the HMRC indicated that there was no VX in the extract. However degradation products such as EMPA and DIPAE, that were traditionally expected of VX were not observed.

To determine the effectivity of Triosyn in decomposing the chemical warfare agent VX, a mixture of these two materials was made at room temperature. Triosyn is an iodinated polymeric bead. In order to isolate the effect of Triosyn on VX from the interaction of the polymeric bead with VX, a separate mixture of polymeric bead and VX was also prepared. Analysis of the chloroform extract of the polymeric bead-VX mixture showed the presence of VX while none was observed in the Triosyn-VX mixture. Since VX was easily observed in the extract from the polymeric bead-VX mixture, this suggests that VX is not irreversibly absorbed into the polymeric bead. The corollary to the preceding statement is that the disappearance of VX in Triosyn-VX mixture indicates chemical change of VX and not absorption into the polymeric bead. GC/MS analysis was conducted on the extract to find the predicted degradation compounds for VX; MS=mass spectrometry. EMPA and DIPAE are traditionally expected when VX decomposes in the environment. The analytical results indicate the absence of these two compounds. At this point, the chloroform extract was blown down and reconstituted with methanol. The methanol extract was submitted for analysis by flow injection ion spray mass spectrometry.

The analytical instrument used was an PE-Sciex taple quadrupole mass spectrometer (API 1 U+model) equipped with an ion spray interface.

FIGS. 2*a* and 2*b* respectively show the product spectra of the protonated authentic VX sample (20 $\mu$g/ml), and the protonated compound EVX (material distinguishable from VX) with m/z 268 from the extract collected under the same conditions. The three prominent ions in the VX product spectrum are at m/z values 166, 128, and 86. On the other hand the protonated compound in the extract has prominent ions at m/z values 144, 128 and 86. Two sets of isobaric ions are found in each of the spectra in FIG. 2 and these are ions with ions with m/z values at 128 and 86. Despite the isobaric ions the product spectrum of VX is different from that of the extract because the intensities of the ions are not comparable. This means that the ion with m/z value of 268 in the extract is not VX acid. This result corroborates the finding of the previously discussed test results that VX was not detectable when mixed with Triosyn.

FIG. 3 illustrate in schematic fashion a chromatographic like column 1 for contacting halide-resin with toxic chemical agent. The chromatographic like column 1 comprises a housing defining a channel chamber which is packed with halide-resin as described above. The column 1 has fluid phase toxic chemical agent input means 3 connected at one end to the channel chamber and at the other end to a source of toxic chemical agent (not shown), The column 1 also has a reaction output means 5 connected to the channel chamber for the removal of reaction product from the channel chamber for transport to a holding means (not shown).

Although a specific embodiment of the invention has been described herein in detail, it is understood that variations may be made thereto by those skilled in the art without departing from the spirit of the invention or the scope of the appended claims.

We claim:

1. A method for deactivating a toxic chemical agent comprising contacting said toxic chemical agent with an iodinated resin, said iodinated resin comprising a demand iodinated resin, wherein said toxic chemical agent is O-ethyl-S-(2-diisopropylamino)ethyl methylphosphonothiolate(VX).

2. A method as defined in claim 1 wherein said iodinated resin comprises a demand iodinated anion exchange resin.

3. A method as defined in claim 1 wherein said iodinated resin comprises a demand iodinated strong base anion exchange resin.

4. A method as defined in claim 1 wherein said resin comprises resin particles and at least a substantial proportion of said particles have a particle size in the range of about 0.1–300 microns.

5. A method as defined in claim 1 wherein said resin comprises resin particles and at least a substantial proportion of said particles have a particle size greater than 300 microns.

6. A method as defined in claim 1 wherein said resin comprises resin particles and at least a substantial proportion of said particles have a particle size in the range of about 0.1–300 microns.

7. A method as defined in claim 1 wherein said resin comprises resin particles and at least a substantial proportion of said particles have a particle size greater than 300 microns.

8. A method for reducing or eliminating unwanted or undesired stockpiles of a toxic chemical agent, which comprises deactivating a toxic chemical agent by contacting said toxic chemical agent with an iodinated resin, said iodinated resin comprising a demand iodinated resin, wherein said toxic chemical agent is O-ethyl-S-(2-diisopropylamino) ethyl methylphosphonothiolate (VX).

9. A system for deactivating a toxic chemical agent, said toxic chemical agent being in a fluid phase, said system comprising:

means for providing a fluid path for the movement of fluid therethrough; and an iodinated resin disposed in said fluid path such that toxic chemical agent in said fluid phase passing through said fluid path is able to be brought into contact with said resin and be deactivated thereby, said iodinated resin comprising a demand iodinated resin;

wherein said toxic chemical agent is O-ethyl-S-(2-diisopropylamino)ethyl methylphosphonothiolate (VX).

10. A method for deactivating a toxic chemical agent, said toxic chemical agent being in a fluid phase, said method comprising passing said toxic chemical agent in said fluid phase through fluid path means over an iodinated resin such that said toxic chemical agent contacts said resin and is deactivated thereby, said iodinated resin comprising a demand iodinated resin, wherein said toxic chemical agent is O-ethyl-S-(2-diisopropylamino)ethyl methylphosphonothiolate(VX).

11. A method as defined in claim 8 wherein said iodinated resin comprises a demand iodinated anion exchange resin.

12. A method as defined in claim 8 wherein said iodinated resin comprises a demand iodinated strong base anion exchange resin.

13. A system as defined in claim 9 wherein said iodinated resin comprises a demand iodinated anion exchange resin.

14. A system as defined in claim 9 wherein said iodinated resin comprises a demand iodinated strong base anion exchange resin.

15. A method as defined in claim 10 wherein said iodinated resin comprises a demand iodinated anion exchange resin.

16. A method as defined in ciaim 10 wherein said iodinated resin comprises a demand iodinated strong base anion exchange resin.

* * * * *